US009044875B2

(12) United States Patent
Shimizu et al.

(10) Patent No.: US 9,044,875 B2
(45) Date of Patent: Jun. 2, 2015

(54) CHAIN SAW

(71) Applicant: HITACHI KOKI CO., LTD., Tokyo (JP)

(72) Inventors: Yasutaka Shimizu, Ibaraki (JP); Kouji Sagawa, Ibaraki (JP); Satoru Matsuno, Ibaraki (JP); Yasuo Etou, Ibaraki (JP); Ai Nakayama, Ibaraki (JP); Miyoji Onose, Ibaraki (JP)

(73) Assignee: HITACHI KOKI CO., LTD., Tokyo (JP)

( * ) Notice: Subject to any disclaimer, the term of this patent is extended or adjusted under 35 U.S.C. 154(b) by 177 days.

(21) Appl. No.: 13/739,520

(22) Filed: Jan. 11, 2013

(65) Prior Publication Data

US 2013/0180118 A1 Jul. 18, 2013

(30) Foreign Application Priority Data

Jan. 16, 2012 (JP) ..... 2012-006622

(51) Int. Cl.

| | |
|---|---|
| ***B27B 17/00*** | (2006.01) |
| ***B27B 17/08*** | (2006.01) |
| ***B27B 17/10*** | (2006.01) |
| ***B27B 17/02*** | (2006.01) |

(52) U.S. Cl.

CPC ..... *B27B 17/083* (2013.01); *B27B 17/10* (2013.01); *B27B 17/02* (2013.01)

(58) Field of Classification Search

CPC ..... B27B 17/083; B27B 17/02; B27B 17/10
USPC ..... 30/384, 382, 383; 83/543, 814, 788
See application file for complete search history.

(56) References Cited

U.S. PATENT DOCUMENTS

| | | | | |
|---|---|---|---|---|
| 3,608,686 | A * | 9/1971 | Martin et al. | 192/150 |
| 3,849,884 | A * | 11/1974 | Arff | 30/383 |
| 4,053,980 | A * | 10/1977 | Poehlman | 30/381 |
| 5,214,750 | A * | 5/1993 | Minowa et al. | 358/1.12 |
| 6,394,061 | B2 * | 5/2002 | Ryu et al. | 123/196 R |
| RE37,832 | E * | 9/2002 | Nakamura et al. | 30/381 |
| 6,473,975 | B1 * | 11/2002 | Sellmann | 30/386 |
| 6,564,459 | B1 * | 5/2003 | Steinbrueck et al. | 30/383 |
| 6,604,348 | B2 * | 8/2003 | Hunt | 56/10.6 |
| 6,662,882 | B2 * | 12/2003 | Hansson | 173/178 |
| 6,698,566 | B2 * | 3/2004 | Jong | 192/131 R |
| 7,795,882 | B2 * | 9/2010 | Kirchner et al. | 324/686 |
| 7,895,913 | B2 * | 3/2011 | Mizon et al. | 74/337.5 |
| 8,016,367 | B2 * | 9/2011 | Hirata | 303/151 |
| 2005/0000775 | A1 * | 1/2005 | Drussel et al. | 192/105 B |

(Continued)

FOREIGN PATENT DOCUMENTS

JP 55-18031 U 2/1980

*Primary Examiner* — Sean Michalski
(74) *Attorney, Agent, or Firm* — Kenealy Vaidya LLP

(57) ABSTRACT

A chain saw includes: a motor driven by electric power; a housing configured to accommodate the motor; a guide bar attached to the housing; a chain blade wound around the guide bar; a sprocket engaged with the chain blade to drive the chain blade, wherein the chain saw is configured to transmit a driving force of the motor to the sprocket via a clutch mechanism, wherein the chain saw comprises a shut-off switch for detecting an actuation of the clutch mechanism and is configured such that the power supply to the motor is stopped when the actuation of the clutch mechanism is detected by the shut-off switch so as to brake electrically. The electrical brake is provided together with a mechanical brake that is configured to work when a hand guard is rotated.

7 Claims, 5 Drawing Sheets

(56) References Cited

U.S. PATENT DOCUMENTS

| | | | | |
|---|---|---|---|---|
| 2006/0084370 | A1* | 4/2006 | Robieu et al. | 451/359 |
| 2006/0086337 | A1* | 4/2006 | Nickel | 123/335 |
| 2006/0102437 | A1* | 5/2006 | Nara et al. | 188/77 R |
| 2006/0135267 | A1* | 6/2006 | Bosk | 464/43 |
| 2006/0196058 | A1* | 9/2006 | Warfel et al. | 30/381 |
| 2006/0231055 | A1* | 10/2006 | Dahlberg | 123/185.3 |
| 2006/0248734 | A1* | 11/2006 | Lawler | 30/382 |
| 2007/0011889 | A1* | 1/2007 | Myers | 30/382 |
| 2007/0234578 | A1* | 10/2007 | Menzel et al. | 30/383 |
| 2007/0240892 | A1* | 10/2007 | Brotto et al. | 173/217 |
| 2008/0016705 | A1* | 1/2008 | Machens et al. | 30/383 |
| 2008/0038073 | A1* | 2/2008 | Paolicelli | 408/99 |
| 2014/0005001 | A1* | 1/2014 | Karrar | 477/204 |
| 2014/0106915 | A1* | 4/2014 | Kistler et al. | 474/111 |

* cited by examiner

CHAIN SAW

This application claims priority from Japanese Patent Application No. 2012-006622 filed on Jan. 16, 2012, the entire subject matter of which is incorporated herein by reference.

TECHNICAL FIELD

The present invention relates to a chain saw for cutting wood or the like by rotationally driving an endless chain blade using a motor as a drive source.

BACKGROUND

The chain saw includes an engine or an electric motor as a drive source. An engine chain saw is generally provided with a centrifugal clutch. When the rotation number of a drive shaft exceeds a setting value, the centrifugal clutch is turned on, so that power is transmitted from the drive shaft to the chain blade and thus the chain blade is rotationally driven. Further, when the rotation number of the drive shaft is less than the setting value, the centrifugal clutch is turned off, so that power transmission from the drive shaft to the chain blade is shut off and thus the chain blade remains in a stopped state.

When rebound of the chain saw occurs during cutting an object to be cut such as the wood, a hand guard is collapsed forward by a hand grasping a handle and thus a chain brake is activated, so that the rotation of the chain blade along a guide bar can be stopped. Incidentally, the chain saw using an electric motor as a drive source includes a mechanical brake which is actuated by an operation of the hand guard or an electrical brake in which driving of the electric motor is stopped by releasing a trigger switch, as disclosed in JP-A-55-18031.

However, when a brake mechanism is actuated by pivoting the hand guard, it is necessary for an operator to move the hand guard and simultaneously return a trigger in order to brake, even if the brake device is installed. Such an operation is cumbersome and thus there is a demand to automatically actuate the brake.

SUMMARY

The present invention has been made to solve the above-described problems and an object of the present invention is to provide a chain saw having a good operability and including a brake device which is not related to the presence or absence of the operation of the hand guard or the trigger.

Another object of the present invention is to provide a chain saw including an electrical brake, in addition to a mechanical brake.

Still another object of the present invention is to provide a chain saw which has a further improved safety by enhancing a procedure to resume rotation of the chain blade after actuation of the brake.

According to one illustrative aspect of the invention, there is provided a chain saw comprising: a motor driven by electric power; a housing configured to accommodate the motor; a guide bar attached to the housing; a chain blade driven by the motor and wound around the guide bar; a sprocket engaged with the chain blade to drive the chain blade, wherein a driving force of the motor is configured to be transmitted to the sprocket via a clutch mechanism, wherein the chain saw comprises a clutch state detection unit configured to detect an actuation of the clutch mechanism, and wherein the power supply to the motor is stopped when the actuation of the clutch mechanism is detected by the clutch state detection unit.

According thereto, the electrical brake is automatically actuated when overload occurs in the chain blade, even if the mechanical brake which is actuated by a hand guard operation of an operator does not work. Accordingly, it is possible to realize a chain saw which has a good operability and an improved safety.

According to another illustrative aspect of the invention, there is provided a chain saw comprising: a motor driven by electric power; a housing configured to accommodate the motor; a guide bar attached to the housing; a chain blade driven by the motor and wound around the guide bar; a hand guard provided at a side of the housing to which the chain blade extends; a mechanical brake configured to suppress the rotation of the chain blade by pivoting the hand guard; and an electrical brake configured to shut off the power supply to the motor when a strong external force is applied to the chain blade, wherein the mechanical brake and the electrical brake are actuated independently of each other without being in conjunction with each other.

According thereto, since not only the mechanical brake device actuated by the operation of the hand guard and but also the electrical brake device acting independently of the mechanical brake is provided, the electrical brake is actuated regardless of the operation of the hand guard and thus the operability of the chain saw is improved.

DETAILED DESCRIPTION

Figure 1:
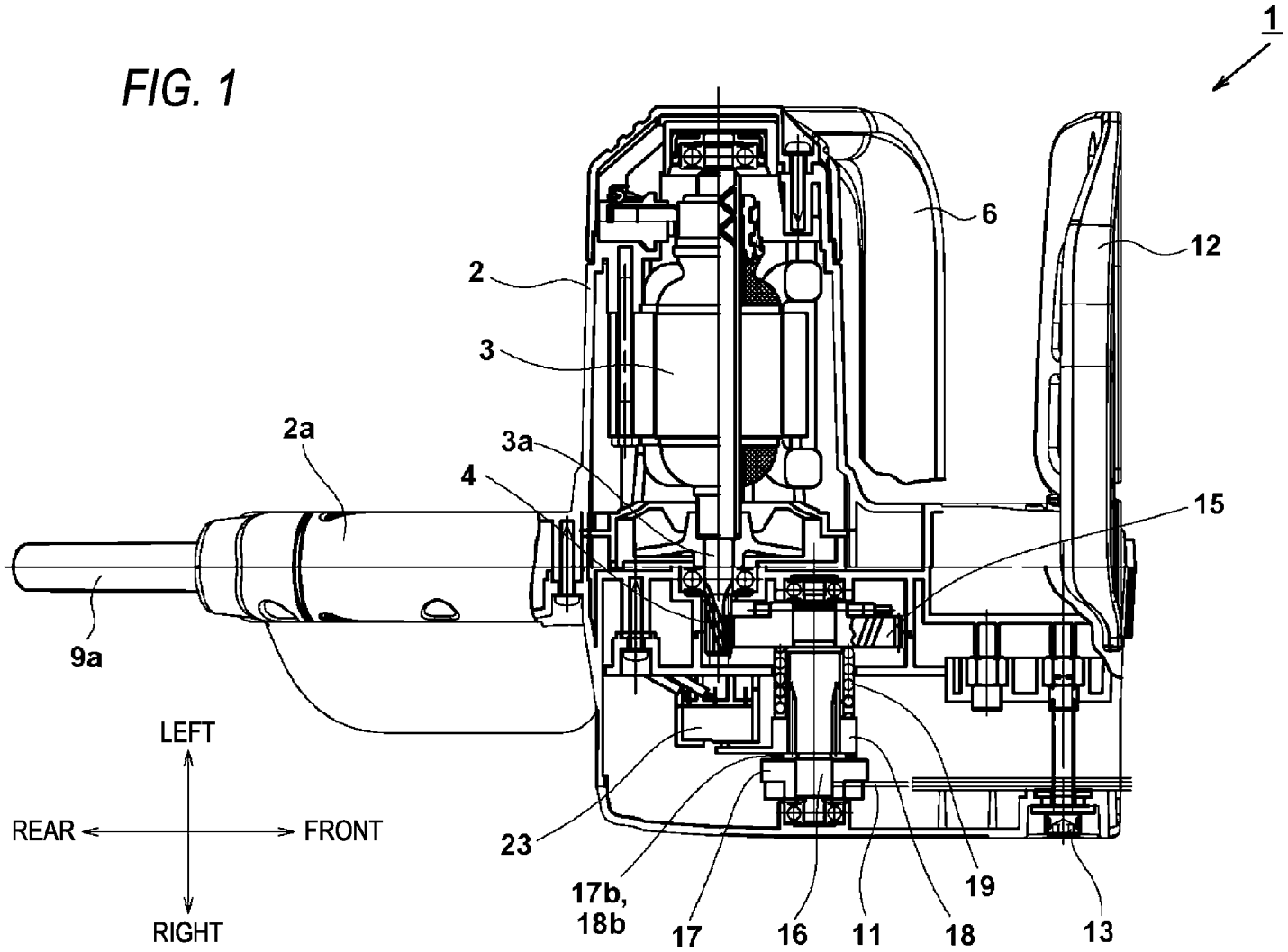
FIG. 1 is a partial sectional view of a chain saw according to an exemplary embodiment of the present invention.

Hereinafter, exemplary embodiments of the present invention will be described with reference to the accompanying drawings. In the following drawings, the same or similar reference numerals are applied to the same or similar parts and elements, and the duplicated description thereof will be omitted. Further, as used herein, a front-rear direction and an upper-lower direction are referred to the directions indicated in the drawings.

FIG. 1 is a partial sectional view of a chain saw 1 according to the present embodiment. The chain saw 1 is an electric tool which is driven by an electrical motor 3 and rotates a chain blade (will be described later) wound around a guide bar (will be described later). The chain saw 1 of the present embodiment includes a housing 2 and a handle part 2*a* is formed at a rear end side of the housing 2. A power cord 9*a* to supply power for driving a motor 3 is connected to a rear end side of the handle part 2*a*. The motor 3 includes a rotational shaft 3*a* which is arranged inside the housing 2 in a direction perpendicular to a front-rear direction of the chain saw 1. The rotational shaft 3*a* has a positional relationship to extend in a left-right direction. As a trigger (will be described later) provided at the handle part 2*a* is pulled, the motor 3 is rotated. The rotating force of the motor 3 is transmitted to a gear 15 which is engaged with a pinion 4. The pinion 4 is integrally formed with the rotational shaft 3*a*. Incidentally, the pinion 4 as a separate part may be pressed-fitted in and fixed to the rotational shaft.

The gear 15 is fixed to one end side (left side) of a spindle 16 whose both ends are rotatably held by a bearing. A sprocket 17 is mounted coaxially with the spindle 16 at an end near the other end (right end) of the spindle 16 which faces the gear 15. Here, the sprocket 17 is rotatable relative to the spindle 16 and thus a rotating force is not transmitted to the sprocket 17 simply by turning the spindle 16. The clutch 18 is urged toward the sprocket 17 by a spring 19. First and second engagement portions (e.g., concave and convex portions 17 *b*, 18 *b*, respectively) are respectively formed at a right side of the clutch 18 and a left side of the sprocket 17 in a circumferential direction. The clutch 18 is urged toward the sprocket 17 by the spring 19 in a state where the concave and convex portions 17 *b*, 18 *b* are fitted to each other.

The clutch 18 is configured so that the relative movement of the clutch to the spindle 16 is possible only in an axial direction but the relative movement thereof is not possible in a circumferential direction. The clutch 18 and the spindle 16 are configured to be rotatable integrally by a spline fitting (connection). Therefore, the spindle 16 is formed with a plurality of keys (convex parts extending in an axial direction) extending in an axial direction. Further, concave parts corresponding to the keys are formed at an inner peripheral side of the clutch 18 which corresponds to the keys. In this manner, a concave and convex shape is formed in a circumferential direction, as seen from a plane perpendicular to a rotating axis of the spindle 16. In order to serve as a clutch mechanism, the concave and convex shape may be configured so that the fitted state of the concave and convex portions 17*b*, 18*b* is released when a given torque is applied to the sprocket 17 and the clutch 18. Incidentally, only the concave parts may be arranged at one of the sprocket 17 and the clutch 18 and only the convex parts may be arranged at the other. Both ends of the spindle 16 are rotatably supported by a bearing member.

The rotating force of the motor 3 transmitted to the spindle 16 is transmitted to the clutch 18 via the spline fitting of the clutch 18 and the spindle 16 and then transmitted to the sprocket 17. The sprocket 17 is provided at its part with teeth having a pitch corresponding to claw parts between drive links of a chain. As the sprocket 17 is rotated, the chain blade 11 is turned while being guided by a guide bar 10.

Figure 2:
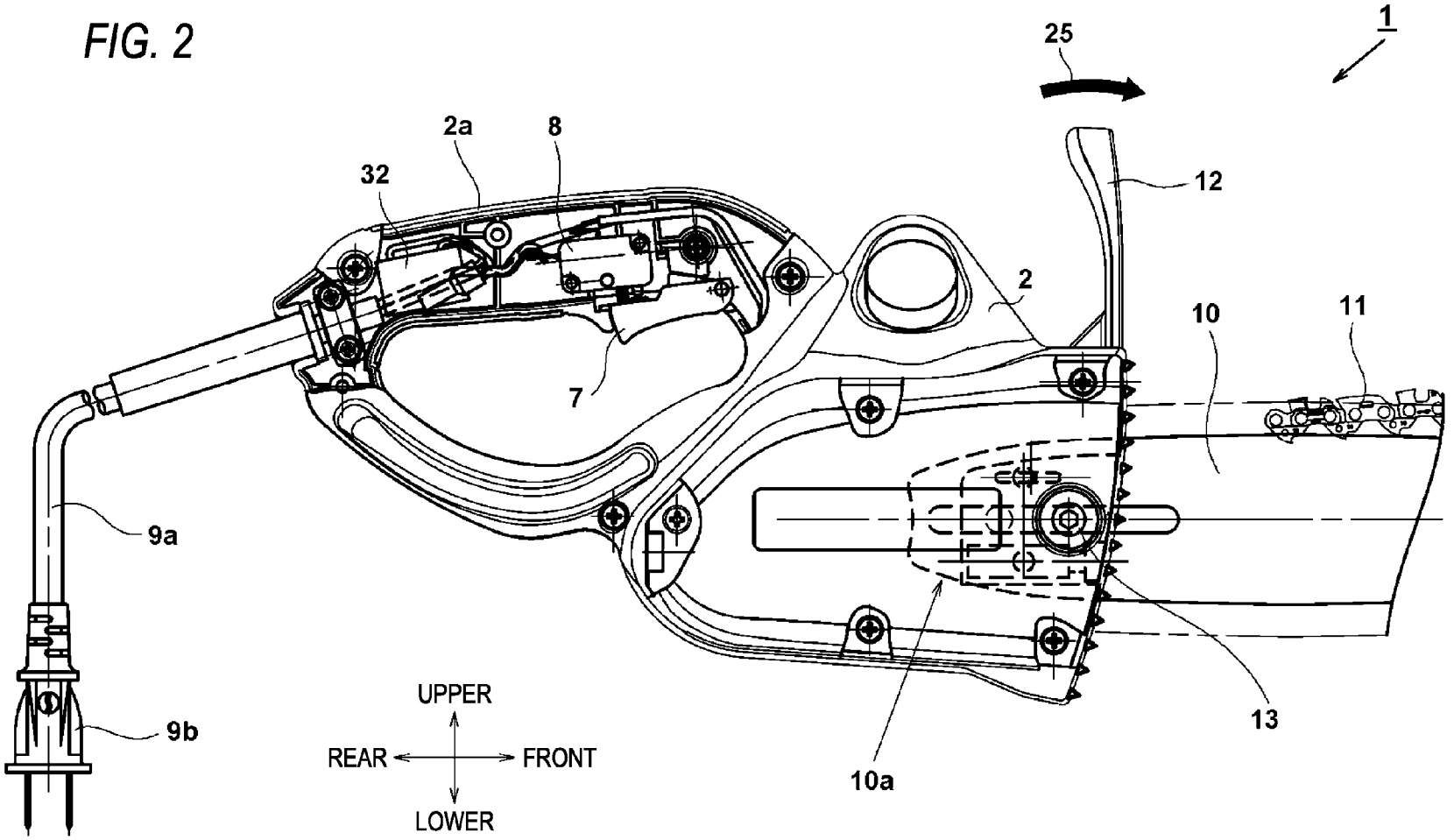
FIG. 2 is a side view of the chain saw according to the exemplary embodiment of the present invention, showing a portion near a handle part in a sectional view.

FIG. 2 is a side view of the chain saw 1 according to the present embodiment, showing a portion near the handle part 2*a* in a sectional view. The handle part 2*a* is formed at a rear side of the housing 2 and is intended to be gripped by one hand of an operator. A trigger 7 is provided at a lower side of the handle part 2*a*. As the trigger 7 is pulled (as the trigger 7 is swung upward), a main switch 8 is turned on. The main switch 8 is a switch for controlling on/off of the rotation of the motor 3. The power cord 9*a* to supply power for rotating the motor 3 is connected to a rear side of the handle part 2*a*. The power cord 9*a* is a connection line for supplying a commercial power supply of AC 100V, for example. An insertion plug 9*b* is provided at an end of the power cord 9*a* which is opposite to the chain saw 1. Incidentally, although a commercial AC power supply is used as a power supply and an AC motor is used as the motor 3 in the chain saw 1 of the present embodiment, the present invention is not limited to this configuration. For example, a rechargeable secondary battery may be used as the power supply and a DC motor may be used as the motor 3.

A hand guard 12 is provided above the chain blade 11 near a front end of the housing 2 and serves to protect an operator's hand from branches or cutting pieces. The hand guard 12 is configured to be swingable in a direction indicated by arrow 25. As the hand guard is swung in this manner, a mechanical brake device (not shown) to brake the rotation of the sprocket 17 is actuated. The guide bar 10 for guiding the chain blade 11 is attached to the housing 2 to extend to the front. A rear end 10*a* of the guide bar 10 is inserted into a guide groove of the housing and fixed by a bolt 13.

Figure 3:
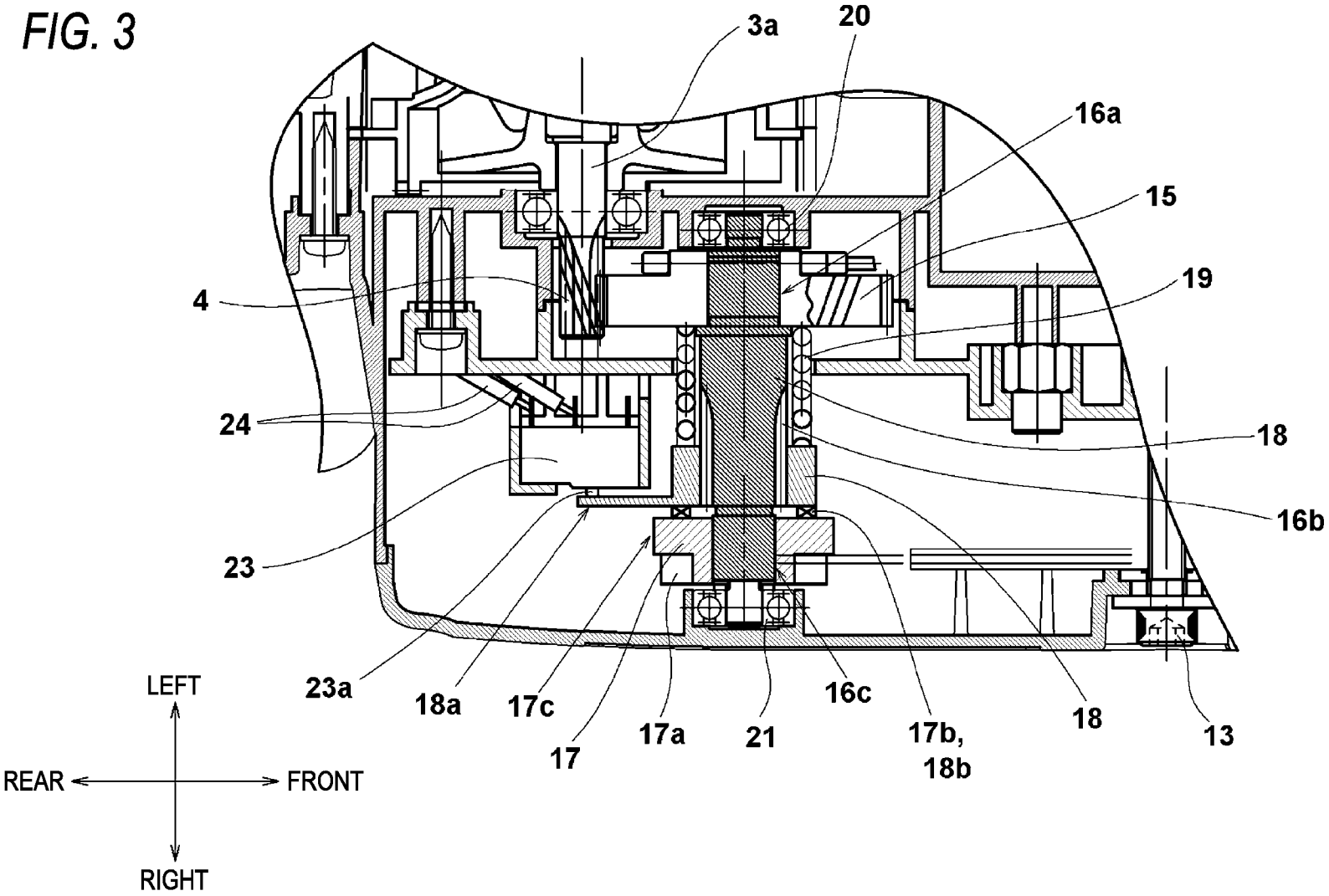
FIG. 3 is an enlarged sectional view of a portion near a clutch mechanism part in the chain saw according to the exemplary embodiment of the present invention.

FIG. 3 is an enlarged sectional view of a portion near a clutch mechanism part in the chain saw 1 according to the present embodiment. The clutch mechanism includes the ring-shaped clutch 18 which is rotatable in an axial direction of the spindle 16, the sprocket 17 which has the concave and convex portions 17*b* corresponding to the concave and convex portions 18*b* of the clutch 18 and the spring 19 which urges the clutch 18 toward the sprocket 17. The spindle 16 is arranged parallel to the drive shaft 3*a* of the motor 3 and both ends thereof are rotatably supported by bearings 20, 21 such as ball bearings. The gear 15 is press-fitted to an end 16*a* of the spindle 16 on the side of the bearing 20. Relative rotation between the spindle 16 and the gear 15 about a rotating axis is not possible. A part near the center of the spindle 16 in a left-right direction has a diameter thicker than the end 16*a*. A plurality of keys 16*b* extending in an axial direction is formed at a part of the spindle on the side of the sprocket 17. Further, concave parts are formed at an inner peripheral side of the clutch 18 which has a substantially cylindrical shape. In this manner, the clutch 18 and the spindle 16 are coupled by a so-called spline connection. Accordingly, the clutch 18 is configured so that the relative movement of the clutch to the spindle 16 is possible only in an axial direction but the relative movement thereof is not possible in a circumferential direction (rotational direction).

The sprocket 17 is provided at an end 16*c* of the spindle 16 on the side of the bearing 21. The sprocket 17 is held to be freely rotatable relative to the spindle 16. Even if the spindle 16 is rotated, the rotating force of the spindle is not transmitted to the sprocket 17. This rotating force is transmitted to the sprocket 17 from the clutch 18 which is non-rotatable relative to the spindle 16. Accordingly, concave and convex portions 17*b* are formed at a side surface (left side surface) of the sprocket 17 on the side of the clutch 18, concave and convex portions 18*b* are formed at a side surface (right side surface) of the clutch 18 on the side of the sprocket 17 and these concave and convex portions 17*b*, 18*b* are fitted to each other. In this way, the rotating force of the spindle 16 is transmitted to the sprocket 17 via the clutch 18. In other words, since the brake device actuated by pivoting the hand guard 12 mechanically brakes the sprocket 17, it is possible to reliably stop the rotation of the chain blade 11.

The sprocket 17 is formed with a gear part 17*a* which is engaged with the chain blade 11 to pivot the chain blade 11. Incidentally, although the chain saw 1 of the present embodiment includes a mechanical brake device in which the rotation of the spindle 16 is braked as the hand guard 12 is swung, the brake device is not shown in FIGS. 1, 3 and 4. The brake device may have a conventional configuration. For example, the brake device may be configured to decelerate the chain blade 11 in such a way that a diameter of a ring (not shown) arranged to cover an outer peripheral surface 17*c* of the sprocket 17 is narrowed as the hand guard 12 is swung and thus the outer peripheral surface 17*c* of the sprocket 17 is tightened by the ring.

When the rotation of the spindle 16 is stopped by the operation of the brake device, the motor 3 is in a locked state and thus there is a risk of burning out the motor. To the contrary, in the present embodiment, power transmission between the sprocket 17 and the spindle 16 is performed via the clutch 18. Accordingly, when the mechanical brake is actuated by an operation of the hand guard 12 or when cutting load exceeds a setting value, the fitted state of the concave and convex portions 17*b* of the sprocket 17 and the concave and convex portions 18*b* of the clutch 18 is released and thus the clutch 18 slides on the spindle shaft against an urging force of the spring 19. In other words, an engagement between the sprocket 17 and the clutch 18 is released when overload is applied to the chain blade 11 during the cutting work, and thus the clutch 18 slides on an output shaft against an urging force of the spring 19. Accordingly, it is possible to immediately shut off the rotating force of the motor 3 transmitted to the chain blade 11. Dislike the centrifugal clutch, the clutch 18 is a clutch as a torque limiter.

In the present embodiment, a shut-off switch 23 is provided near the clutch 18 and turned on when the clutch 18 is operated. As the shut-off switch 23, a micro-switch which is turned on when a plunger 23*a* is pressed down can be used. In order to operate the shut-off switch 23, the clutch 18 of the present embodiment is formed with a flange part 18*a* which extends from a portion of the clutch to near the plunger 23*a*. The flange part 18*a* serves as an operating part to turn on the shut-off switch 23. The shape of the flange part 18*a* can be freely selected as long as the plunger 23*a* of the shut-off switch 23 can be operated.

Figure 4:
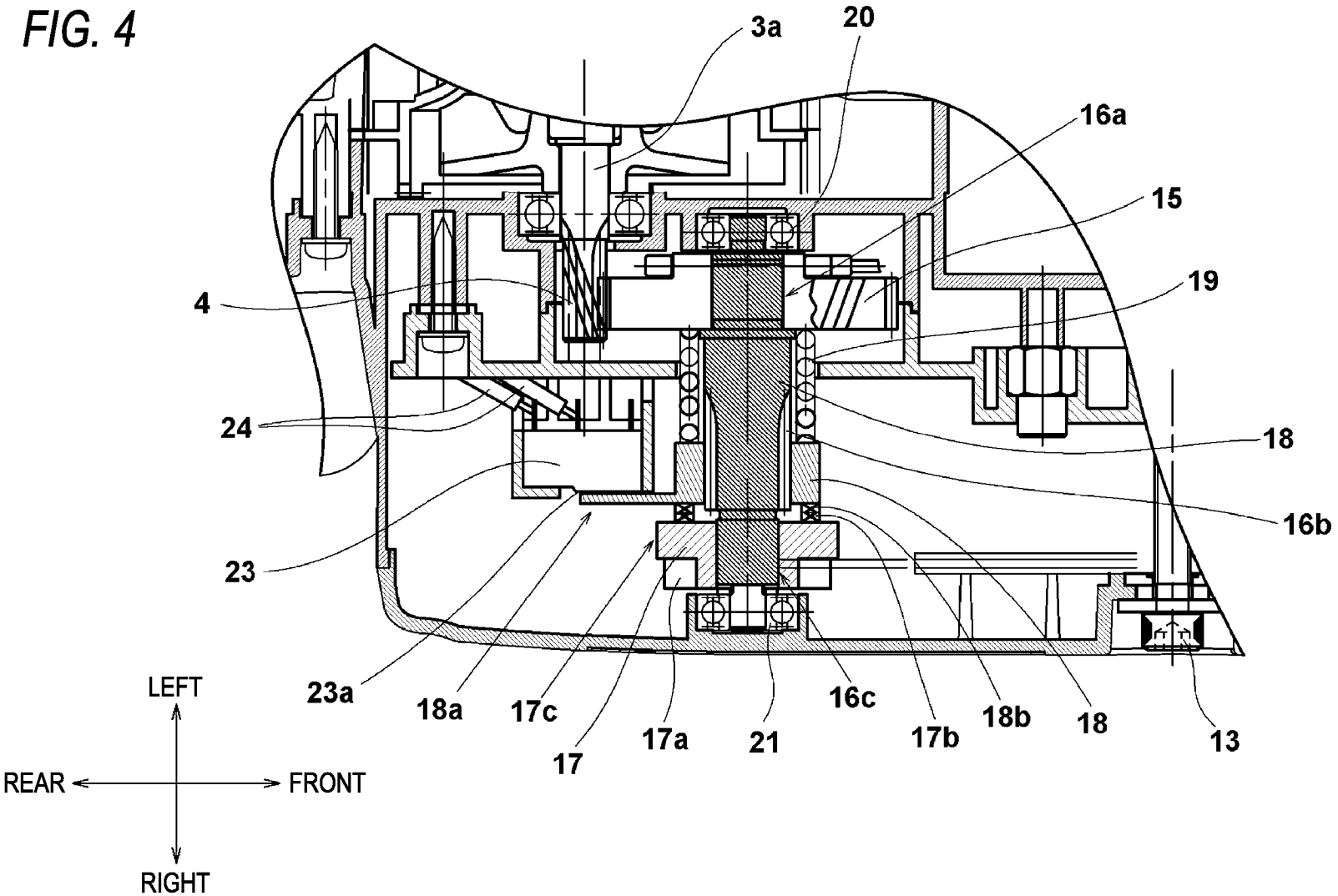
FIG. 4 is an enlarged sectional view of a portion near the clutch mechanism part in the chain saw according to the exemplary embodiment of the present invention, showing a state where the clutch mechanism is operated.

During a normal operation of the chain blade 11, that is, in a state where the clutch 18 is connected to the sprocket 17, the flange part 18*a* does not press the plunger 23*a* and thus the shut-off switch 23 is in an off state. However, when the clutch 18 is actuated for some reason and the power transmission from the clutch 18 to the sprocket 17 is shut off, the clutch 18 is moved axially to the left (in a direction away from the sprocket 17) against the urging force of the spring 19. Accordingly, the flange part 18*a* is also moved in accordance with the movement of the clutch and thus the flange part 18*a* pushes the plunger 23*a*. This state is shown in FIG. 4. As the plunger 23*a* is pushed, the shut-off switch 23 is turned on and an operating state of the shut-off switch 23 is transmitted to a control device of the motor 3 which is connected to the shut-off switch 23 via a lead wire 24. In other words, the power supply to the motor 3 is stopped by moving the plunger 23*a* of the switch 23 whose operating part is arranged near the clutch member 18 when the clutch mechanism is actuated. Accordingly, it is possible to reliably stop the rotation of the motor 3 in conjunction with the operation of the clutch mechanism.

Figure 5:
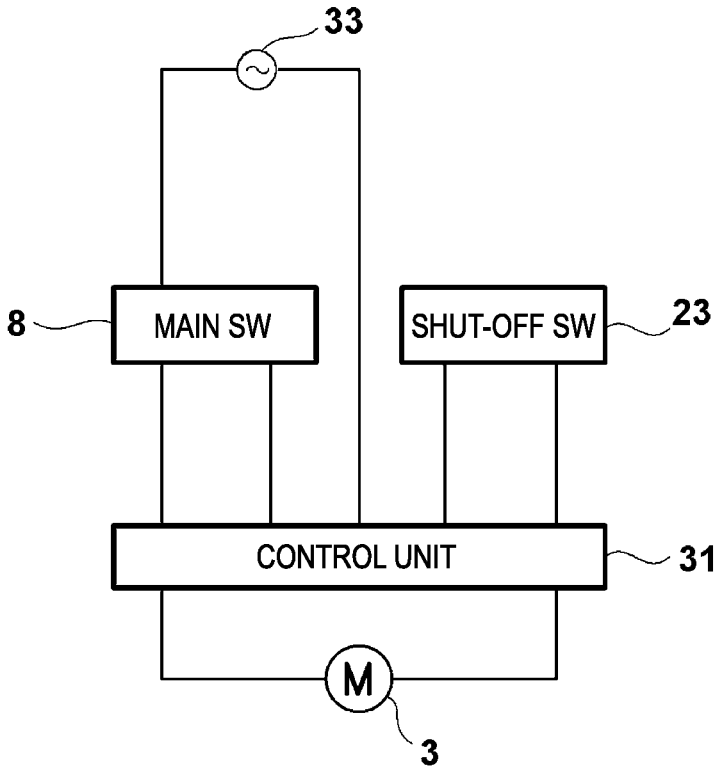
FIG. 5 is a block diagram showing a control circuit of the chain saw according to the exemplary embodiment of the present invention.

Next, a control circuit of the chain saw according to the present embodiment is described with reference to a block diagram of FIG. 5. Although the rotation of the motor 3 is started when the main switch 8 is turned on, the rotation of the motor is controlled by a control unit 31. A commercial power supply 33 for supplying power to the motor 3 is connected to the control unit 31. The commercial power supply 33 is connected to the control unit 31 via the main switch 8 by the power cord 9*a* (see, FIG. 2). Further, the control unit 31 is also connected to the shut-off switch 23 which is turned on when the clutch mechanism is actuated. As the shut-off switch 23 is turned on during the rotation of the motor 3, the control unit 31 immediately stops the power supply to the motor 3. According to this configuration, it is possible to reliably stop the motor 3, not only in a case where the mechanical brake operated by the hand guard 12 is actuated, but also in a case where a constant load is applied to the chain blade 11 and thus the clutch mechanism is actuated. Such a stop of the motor 3 causes the chain blade 11 to be braked and thus this operation effectively serves as an electric actuator. In other words, a brake device configured to suppress the rotation of the chain blade 11 by pivoting the hand guard 12 is provided, in addition to the electrical brake. Accordingly, it is possible to easily stop the rotation of the chain blade 11 in accordance with intention of an operator. Further, since the brake device is operated and simultaneously the rotation of the motor 3 can be stopped, the operation of the electrical brake can be used together.

When the shut-off switch 23 is turned on and thus the motor 3 is stopped, the clutch 18 returns to the connected state by the urging force of the spring 19 and the shut-off switch 23 is turned off. However, the control unit 31 is configured so that the power supply to the motor 3 is stopped when the shut-off switch 23 is turned on and the power supply to the motor 3 is resumed when an operator temporarily releases (turns off) the main switch 8 and then again pushes (turns on) the main switch 8. With this configuration, safety can be further enhanced, as compared to a conventional electrical chain saw 1. In other words, a control device (control unit 31) is configured to release the shut-off of the power supply by detecting that the operation of a trigger switch (the trigger 7 and the main switch 8) is released after the shut-off of the power supply to the motor 3, so that the rotation of the motor 3 is not resumed until the trigger 3 is released by an operator. Accordingly, since the control device can reliably confirm the work resuming intention of the operator to temporarily release the trigger 3 and then again to pull the trigger 3, it is possible to reliably realize a chain saw 1 having a further improved safety.

Incidentally, as is often the case that the clutch mechanism is intermittently activated multiple times in a short interval. However, the timing when the power supply to the motor 3 is stopped or decreased or the timing when the power supply to the motor 3 is resumed may be properly set depending on the application and situation of the chain saw 1 used. In addition, when the control unit 31 is configured by the micro-computer, an advanced motor control is possible. Further, although a brushed DC motor is used as the motor 3 in the present embodiment, the other electric motors, for example, a brushless DC motor may be used as the motor 3.

Hereinabove, the present invention has been described with reference to the exemplary embodiment. However, the present invention is not limited to the above-described embodiment, but a variety of changes can be made without departing from the scope of the invention. For example, the above-described clutch mechanism and the switch mechanism for detecting the operation of the clutch mechanism are not limited to the above-described configuration, but may be realized by other clutch mechanism and a mechanical, an optical or a magnetic switch mechanism for detecting the operation of the clutch mechanism.

What is claimed is:

1. A chain saw comprising:

a motor driven by electric power;

a housing configured to accommodate the motor;

a guide bar attached to the housing;

a chain blade driven by the motor and wound around the guide bar;

a sprocket engaged with the chain blade to drive the chain blade;

a trigger switch; and a control device connected to the trigger switch and configured to control rotation of the motor, wherein a driving force of the motor is configured to be transmitted to the sprocket via a clutch mechanism, wherein the chain saw comprises a clutch state detection unit configured to detect an actuation of the clutch mechanism, and wherein the power supply to the motor is stopped when the actuation of the clutch mechanism is detected by the clutch state detection unit, wherein the clutch state detection unit is connected to the control device, wherein the control device is configured to shut off the power supply to the motor when an operation of the clutch state detection unit is detected by the control device, and wherein the control device is configured to release the shut-off of the power supply upon detecting that the operation of the trigger switch is released after the shutoff of the power supply to the motor.

2. The chain saw according to claim 1, wherein the clutch state detection unit comprises a switch configured to switch between on and off states in accordance with the actuation of the clutch mechanism.

3. The chain saw according to claim 1, wherein the clutch mechanism comprises:

first engagement portions formed at the sprocket;

a clutch member having second engagement portions corresponding to the first engagement portions of the sprocket and being configured to be urged by a spring to abut against the sprocket; and a spindle coupled to the clutch member by a spline connection formed at an inner periphery of the clutch member and an outer periphery of the spindle to transmit a rotating force of the motor, and wherein the power transmission from the clutch member to the sprocket is configured to be released when overload is applied to the chain blade and the clutch member slides in an axial direction of the spindle against an urging force of the spring.

4. The chain saw according to claim 3, wherein the clutch member comprises an actuation part at an outer periphery thereof, and wherein the actuation part is configured to move a plunger of the clutch state detection unit, which is arranged near the clutch member, when the clutch mechanism is actuated and the power supply to the motor is stopped.

5. The chain saw according to claim 1, further comprising:

a hand guard provided at a side of the housing to which the chain blade extends and, a brake device configured to suppress the rotation of the chain blade by pivoting the hand guard, wherein the clutch mechanism is configured to be actuated when the brake device is actuated and the power supply to the motor is stopped.

6. The chain saw according to claim 5, wherein the brake device is configured to mechanically brake the sprocket.

7. A chain saw comprising:

a motor driven by electric power;

a housing configured to accommodate the motor;

a guide bar attached to the housing;

a chain blade driven by the motor and wound around the guide bar;

a hand guard provided at a side of the housing to which the chain blade extends;

a mechanical brake configured to suppress the rotation of the chain blade by pivoting the hand guard;

an electrical brake configured to shut off the power supply to the motor when a strong external force is applied to the chain blade;

a sprocket engaged with the chain blade to drive the chain blade;

a trigger switch; and a control device connected to the trigger switch and configured to control rotation of the motor, wherein the mechanical brake and the electrical brake are actuated independently of each other without being in conjunction with each other, wherein a driving force of the motor is configured to be transmitted to the sprocket via a clutch mechanism, wherein the chain saw comprises a clutch state detection unit configured to detect an actuation of the clutch mechanism, wherein the power supply to the motor is stopped when the actuation of the clutch mechanism is detected by the clutch state detection unit wherein the clutch state detection unit is connected to the control device, wherein the control device is configured to shut off the power supply to the motor when an operation of the clutch state detection unit is detected by the control device, and wherein the control device is configured to release the shut-off of the power supply upon detecting that the operation of the trigger switch is released after the shutoff of the power supply to the motor.

* * * * *